US011655652B2

(12) United States Patent
Mäkitalo et al.

(10) Patent No.: US 11,655,652 B2
(45) Date of Patent: May 23, 2023

(54) VEHICLE STORAGE COMPARTMENT ARRANGEMENT

(71) Applicant: Volvo Truck Corporation, Gothenburg (SE)

(72) Inventors: André Mäkitalo, Gothenburg (SE); Andreas Wilson, Gothenburg (SE)

(73) Assignee: Volvo Truck Corporation, Gothenburg (SE)

( * ) Notice: Subject to any disclaimer, the term of this patent is extended or adjusted under 35 U.S.C. 154(b) by 769 days.

(21) Appl. No.: 16/610,390

(22) PCT Filed: May 4, 2017

(86) PCT No.: PCT/EP2017/060593
§ 371 (c)(1),
(2) Date: Nov. 1, 2019

(87) PCT Pub. No.: WO2018/202295
PCT Pub. Date: Nov. 8, 2018

(65) Prior Publication Data

US 2020/0056399 A1 Feb. 20, 2020

(51) Int. Cl.
*E05B 1/00* (2006.01)
*E05C 9/04* (2006.01)
(Continued)

(52) U.S. Cl.
CPC ..... *E05B 1/0046* (2013.01); *E05C 9/006* (2013.01); *E05C 9/041* (2013.01); *E05C 9/043* (2013.01);
(Continued)

(58) Field of Classification Search
CPC ..... E05B 1/0046; E05B 17/0037; E05B 65/0021; E05B 83/28; E05C 9/006; E05C 9/041; E05C 9/043; E05C 9/042
See application file for complete search history.

(56) References Cited

U.S. PATENT DOCUMENTS 1,142,463 A * 6/1915 Shepherd ..... E05B 59/00 70/DIG. 65
RE15,619 E * 6/1923 Massoll ..... E05C 9/041 292/39
(Continued)

FOREIGN PATENT DOCUMENTS

CN 103867052 A 6/2014
CN 203714004 U 7/2014
(Continued)

OTHER PUBLICATIONS

First Office Action for Chinese Patent Application No. 201780090338.2, dated Sep. 2, 2020, 11 pages.
(Continued)

*Primary Examiner* — Mark A Williams
(74) *Attorney, Agent, or Firm* — Withrow & Terranova, PLLC

(57) ABSTRACT

The present invention relates to a vehicle storage compartment arrangement (100), comprising a storage compartment (102) and a cover arrangement (104), said cover arrangement being connected to the storage compartment (102) and slidably movable along a first geometric axis (202) between an opened position and a closed position, wherein said cover arrangement comprises a locking mechanism (106, 406, 506) for connecting the cover arrangement to the storage compartment, said locking mechanism comprising a first (108) and a second (110) locking pin movable along a second geometric axis (204), said first and second geometric axis being substantially perpendicular to each other, wherein the first and second locking pins are controllable between a first state in which the cover arrangement is locked to the storage compartment, and a second state in which the cover arrangement is unlocked from the storage compartment, wherein the cover arrangement further comprises an actuation handle (112) connected to the first and second locking
(Continued)

pins by means of at least one pre-tensioned spring (114, 116, 514), wherein said first and second locking pins are arranged in said second state when said actuation handle is moved along said second geometric axis.

11 Claims, 7 Drawing Sheets

(51) Int. Cl.

| | |
|---|---|
| ***E05C 9/00*** | (2006.01) |
| *E05B 17/00* | (2006.01) |
| *E05B 65/00* | (2006.01) |
| *E05B 83/28* | (2014.01) |

(52) U.S. Cl.
CPC ..... *E05B 17/0037* (2013.01); *E05B 65/0021* (2013.01); *E05B 83/28* (2013.01); *E05C 9/042* (2013.01)

(56) References Cited

U.S. PATENT DOCUMENTS

| | | | | | |
|---|---|---|---|---|---|
| 2,166,535 | A | * | 7/1939 | Sarenholm | E05C 9/041 292/5 |
| 4,130,306 | A | * | 12/1978 | Brkic | E05B 65/1053 292/335 |
| 4,335,816 | A | | 6/1982 | Rager | |
| 5,102,174 | A | * | 4/1992 | Prevot | E05C 9/021 292/336.3 |
| 5,253,903 | A | * | 10/1993 | Daley | E05C 9/041 292/336.3 |
| 5,253,917 | A | * | 10/1993 | Brueggemann | B60J 7/19 74/109 |
| 5,437,485 | A | * | 8/1995 | Goldschmidt | E05B 15/0053 49/362 |
| 2016/0340942 | A1 | | 11/2016 | Anderson et al. | |
| 2017/0009497 | A1 | | 1/2017 | Nakasone | |

FOREIGN PATENT DOCUMENTS

| | | | |
|---|---|---|---|
| CN | 105696876 | A | 6/2016 |
| CN | 106065747 | A | 11/2016 |
| CN | 106460421 | A | 2/2017 |
| DE | 2323776 | A1 | 11/1974 |
| GB | 197257 | A | 5/1923 |
| JP | S60177262 | U | 11/1985 |
| JP | S6145074 | A | 3/1986 |
| WO | 2015120034 | A1 | 8/2015 |
| WO | 2015123442 | A1 | 8/2015 |

OTHER PUBLICATIONS

International Search Report and Written Opinion for International Patent Application No. PCT/EP2017/060593, dated Feb. 2, 2018, 14 pages.

International Preliminary Reporton Patentability for International Patent Application No. PCT/EP2017/060593, dated Apr. 2, 2019, 7 pages.

* cited by examiner

VEHICLE STORAGE COMPARTMENT ARRANGEMENT

This application is a 35 USC 371 national phase filing of International Application No. PCT/EP2017/060593, filed May 4, 2017, the disclosure of which is incorporated herein by reference in its entirety.

TECHNICAL FIELD

The present invention relates to a vehicle storage compartment arrangement particularly suitable for arrangement in a cabin of a heavy duty vehicle. The invention is thus applicable on vehicles, in particularly low, medium and heavy duty vehicles commonly referred to as trucks. Although the invention will mainly be described in relation to a truck, it may also be applicable for other type of vehicles as well such as e.g. buses, caravans, camper cars, excavators, dumpers, boats, etc.

BACKGROUND

In connection to low-, medium and heavy duty vehicles, also commonly referred to as trucks, the vehicle cabin is often provided with a sleeping place having a bed onto which the operator of the vehicle can rest. The interior of the cabin is also often provided with a vehicle storage compartment. This vehicle storage compartment is thus arranged to contain belongings for the operator and passengers of the vehicle.

To prevent the objects contained in the vehicle storage compartment from falling out when driving the vehicle, a cover arrangement is preferably used. Hereby, the cover arrangement is closed when driving and opened when it is desirable to gain access to the objects within the vehicle storage compartment.

It is important that the cover arrangement is sufficiently connected to the vehicle storage compartment such that it is not accidentally opened during operation of the vehicle. This is especially important in the event the vehicle is accidentally exposed to a so-called roll-over situation exposing the cover arrangement to relatively high loading. There is thus a desire to provide a locking arrangement for a cover arrangement of a vehicle storage compartment arrangement fulfilling the requirements of keeping the cover arrangement in a locked position even when the vehicle is exposed to high loading. Although sufficient locking properties are desirable, it should still be relatively easy to gain access to the storage compartment when needed.

SUMMARY

It is an object of the present invention to provide a vehicle storage compartment arrangement which at least partially overcomes the above described deficiencies. This is achieved by a vehicle storage compartment arrangement according to claim 1.

According to a first aspect of the present invention, there is provided a vehicle storage compartment arrangement, comprising a storage compartment and a cover arrangement, the cover arrangement being connected to the storage compartment and slidably movable along a first geometric axis between an opened position and a closed position, wherein the cover arrangement comprises a locking mechanism for connecting the cover arrangement to the storage compartment, the locking mechanism comprising a first and a second locking pin movable along a second geometric axis, the first and second geometric axis being substantially perpendicular to each other, wherein the first and second locking pins are controllable between a first state in which the cover arrangement is locked to the storage compartment, and a second state in which the cover arrangement is unlocked from the storage compartment, wherein the cover arrangement further comprises an actuation handle connected to the first and second locking pins by means of at least one pre-tensioned spring, wherein the first and second locking pins are arranged in the second state when the actuation handle is moved along the second geometric axis.

The wording "storage compartment" should be understood to mean an arrangement, preferably positioned within the vehicle compartment, and arranged for storage. Such storage compartment may thus be arranged as a locker, cabinet, shelf, etc.

Also, the wording "substantially perpendicular" should be construed as including some tolerances. Hence, the mutual relationship between the first and second geometric axis should not be construed as limited to strictly 90 degrees, but rather within the range between 75-105 degrees, preferably within the range between 85-95 degrees, and most preferably 90 degrees.

Still further, the wording geometric axis should be understood to mean that e.g. the cover arrangement is movable in two directions of the first geometric axis. Similarly, the first and second locking pins are movable in two directions of the second geometric axis.

An advantage is that the cover arrangement will be lockable by means of two locking pins which will provide for improved safety against accidental opening of the cover arrangement when the vehicle is driven in rough terrain or even during roll-over situations of the vehicle. Furthermore, providing the locking mechanism in the second direction enables for the use of twin/double cover arrangements without the need of connecting/locking such cover arrangements to each other. Hence, no bulky connecting mechanism is needed which makes the vehicle storage compartment arrangement slender in design.

Furthermore, the actuation handle can be used for both unlocking the cover arrangement from the storage compartment as well as opening the cover arrangement for gaining access to the inside of the storage compartment. Hence, the actuation handle can firstly be moved in the second direction for unlocking and thereafter moved in the first direction for opening the cover arrangement.

According to an example embodiment, the pre-tensioned spring may be arranged to force the first and second locking pins outwardly of the cover arrangement in a direction along the second geometric axis.

Hereby, the locking mechanism is a so-called normally closed locking mechanism which means that it is locking the cover arrangement to the storage compartment when the storage compartment is arranged in its closed position, until actively unlocking it therefrom. If the cover arrangement is at least partially opened, i.e. the cover arrangement is half open, the locking mechanisms will be forced against a guiding rail of the vehicle storage compartment arrangement for keeping the cover arrangement in that specific position. Hence, the first and second locking pins will exert a pressure against the guiding rail when the operator is not operating the actuation handle.

According to an example embodiment, the first and second locking pins may be positioned on a respective side portion of the first geometric axis of the cover arrangement. Thus, the cover arrangement is lockable to the storage compartment on a respective side portion thereof as seen in the direction of opening the cover arrangement.

According to an example embodiment, the actuation handle may be connected to the first locking pin by means of a first pre-tensioned spring, and to the second locking pin by means of a second pre-tensioned spring.

According to an example embodiment, the actuation handle may be positioned in a home position when the first and second locking pins are arranged in the first state, and wherein the at least one pre-tensioned spring is arranged to re-position the actuation handle in the home position after the actuation handle is moved along the second geometric axis for arranging the first and second locking pins in the second state.

Hereby, the actuation handle is always provided back to its initial position after activation thereof.

According to an example embodiment, the storage compartment may comprise guiding rails for allowing the cover arrangement to be slidably movable along the first geometric axis, the guiding rails comprises a plurality of indentations spaced apart from each other in the direction of the first geometric axis.

As described above, the cover arrangement may be arranged to slide in the guiding rails. By arranging a plurality of indentations, the cover arrangement can be locked in e.g. a half open position, a semi half-open position, or any other position between the opened and closed positions.

According to an example embodiment, the first and second locking pins may be arranged in the second state when the actuation handle is moved in either one of a first and a second direction of the second geometric axis.

An advantage is thus that the operator can choose to move the actuation handle either upwards or downwards and achieve the same effect.

According to an example embodiment, the cover arrangement may further comprise a rotatable wheel connected to the first and second locking pins.

According to an example embodiment, the rotatable wheel may comprise gear teeth arranged in meshed connection with gear teeth of the first and second locking pins.

Hereby, the rotatable wheel and the first and second locking pins may be arranged as a rack-and-pinion arrangement, whereby rotation of the rotatable wheel will provide a movement along the second geometric axis of the first and second locking pins.

According to an example embodiment, the rotatable wheel may be an oval shaped wheel, the oval shaped wheel being pivotably connected to each of the first and second locking pins. An oval shaped wheel will provide a relatively straight motion of the locking mechanism without the need of being thereof.

According to an example embodiment, the cover arrangement may be a jalousie.

According to a second aspect, there is provided a vehicle comprising a vehicle compartment, the vehicle compartment being provided with a vehicle storage compartment arrangement according to any one of the example embodiments described above in relation to the first aspect.

Effects and features of the second aspect are largely analogous to those described above in relation to the first aspect.

According to a third aspect, there is provided a cover arrangement for a storage compartment arranged within a vehicle, the cover arrangement being arranged to be slidably movable along a first geometric axis between an opened position and a closed position, wherein the cover arrangement comprises a locking mechanism arranged for connecting the cover arrangement to the storage compartment, the locking mechanism comprising a first and a second locking pin movable along a second geometric axis, the first and second geometric axis being substantially perpendicular to each other, wherein the first and second locking pins are arranged between a first state in which the cover arrangement is arranged to be locked to the storage compartment, and a second state in which the cover arrangement is arranged to be unlocked from the storage compartment, wherein the cover arrangement further comprises an actuation handle connected to the first and second locking pins by means of at least one pre-tensioned spring, wherein the first and second locking pins are arranged in the second state when the actuation handle is moved along the second geometric axis.

Effects and features of the third aspect are largely analogous to those described above in relation to the first aspect.

Further features of, and advantages with, the present invention will become apparent when studying the appended claims and the following description. The skilled person will realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
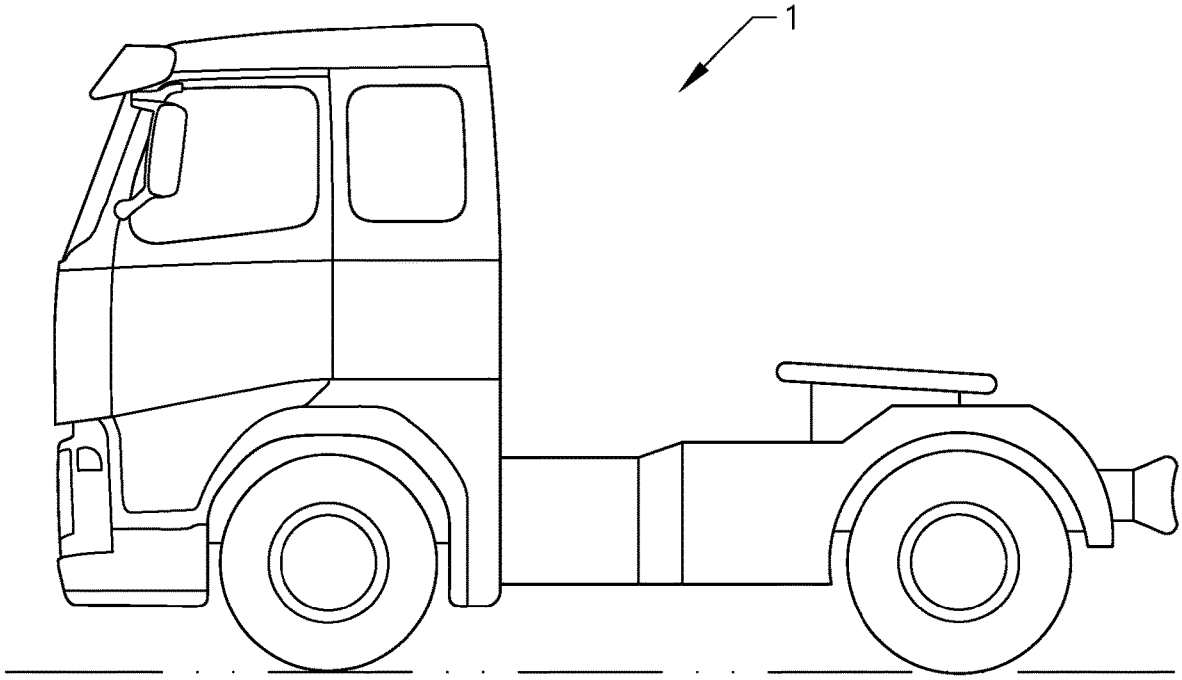
FIG. 1 is a lateral side view illustrating an example embodiment of a vehicle in the form of a truck.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, there is provided a vehicle 1 in the form of a truck for which the vehicle storage compartment arrangement (100 in FIG. 2) is particularly suitable for. The vehicle storage compartment arrangement 100 may however be provided and used in other applications as well, such as e.g. buses, caravans, camper cars, etc. For simplicity, the following will however only describe the vehicle storage compartment arrangement 100 in relation to a position within a cabin of a truck.

Figure 2:
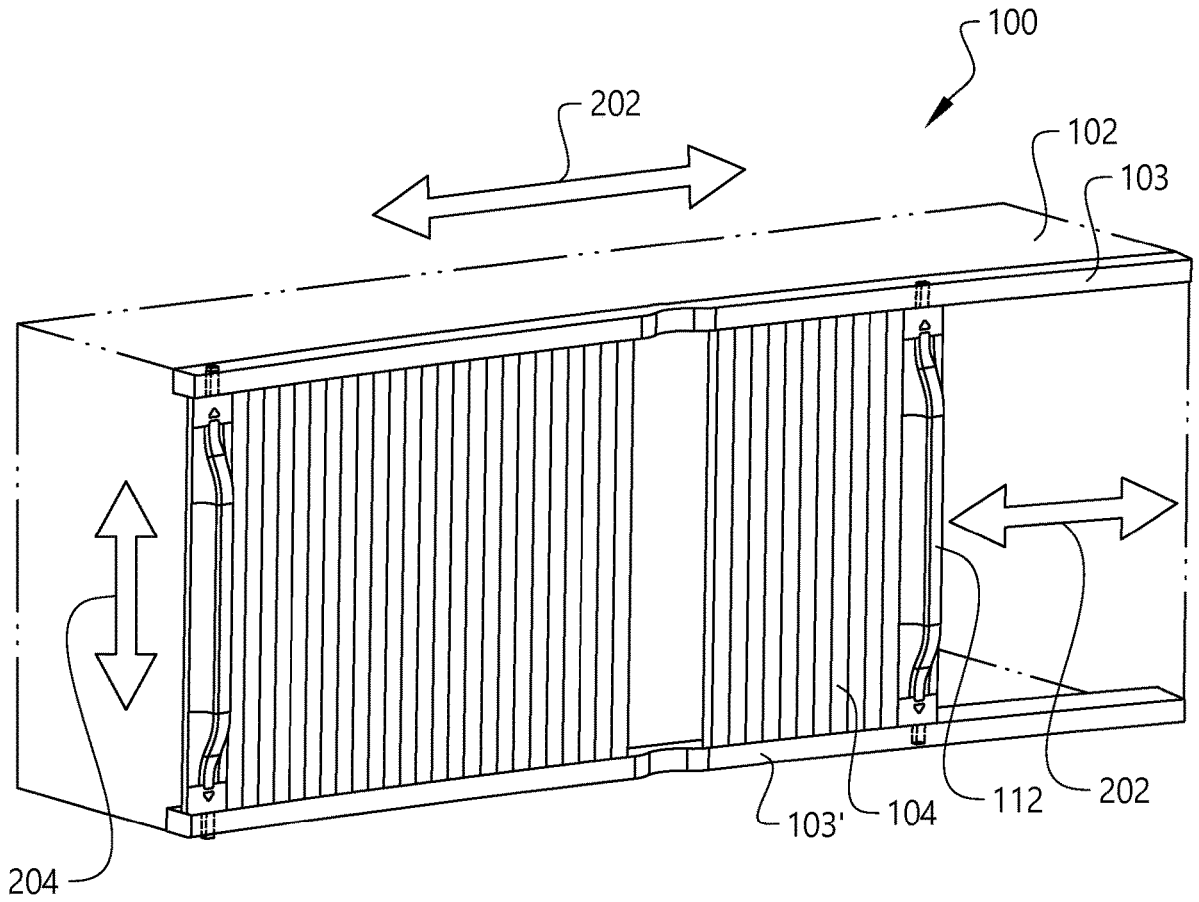
FIG. 2 is a perspective view illustrating a vehicle storage compartment arrangement according to an example embodiment.

Reference is therefore made to FIG. 2, which is a perspective view illustrating the vehicle storage compartment arrangement 100 according to an example embodiment. As is depicted in FIG. 2, the vehicle storage compartment arrangement 100 comprises a storage compartment 102, in which an operator of the vehicle 1 can provide his/her belongings and other articles. The vehicle storage compartment arrangement 100 further comprises a cover arrangement 104 for opening and closing the access to the storage compartment 102. Hence, the cover arrangement 104 is movable between a closed position and an opened position by being slidably movable in a pair of guiding rail 103, 103'. In particular, the cover arrangement 104 is slidably movable in an upper 103 and a lower 103' guiding rail along a first geometric axis 202. The cover arrangement 104 can of course also be movable along a curvature or along a radius as well, or along a direction formed as a spline. The cover arrangement 104 is preferably arranged as a jalousie which may be positioned in a semi-opened position, i.e. being locked/connected to the guiding rails 103, 103' for gaining partial access to the interior of the storage compartment 102. According to an example, the cover arrangement 104 can be attached to the guiding rails 103, 103' at predefined positions along the direction of the first geometric axis 202. This may be realized by providing a plurality of indentations (not shown) in the guiding rails, which indentations are spaced apart from each other in the direction of the first geometric axis.

According to the illustration in FIG. 2, the vehicle storage compartment arrangement 100 comprises two storage compartments 102 and two cover arrangements 104.

However, the invention should be construed as being equally applicable with only one storage compartment 102 and one cover arrangement 104.

As further depicted in FIG. 2, the cover arrangement 104 comprises an actuation handle 112. The actuation handle 112 is arranged for controlling a locking mechanism (see e.g. 106 in FIGS. 3*a*-3*b*) for unlocking the cover arrangement 104 from the storage compartment 102, which will be described in further detail below in relation to the description of FIGS. 3*a*-5. The actuation handle 112 is also arranged for opening and closing the cover arrangement 104, by means of moving the actuation handle 112 in a direction of the first geometric axis 202.

Figure 3A:
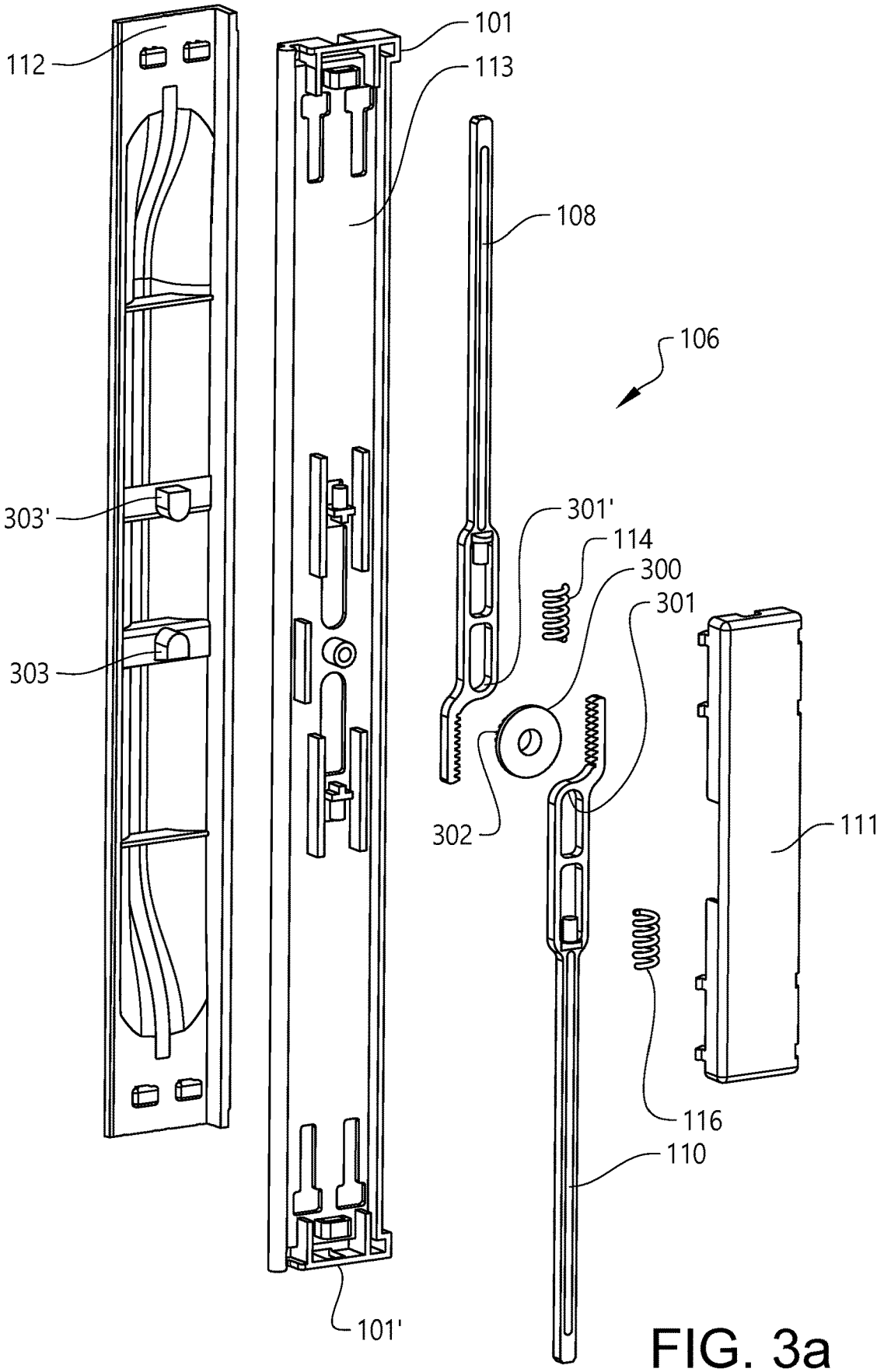
FIGS. 3*a*-3*b* illustrate an example embodiment of a locking mechanism for a cover arrangement of the vehicle storage compartment arrangement in FIG. 1.
Figure 3B:
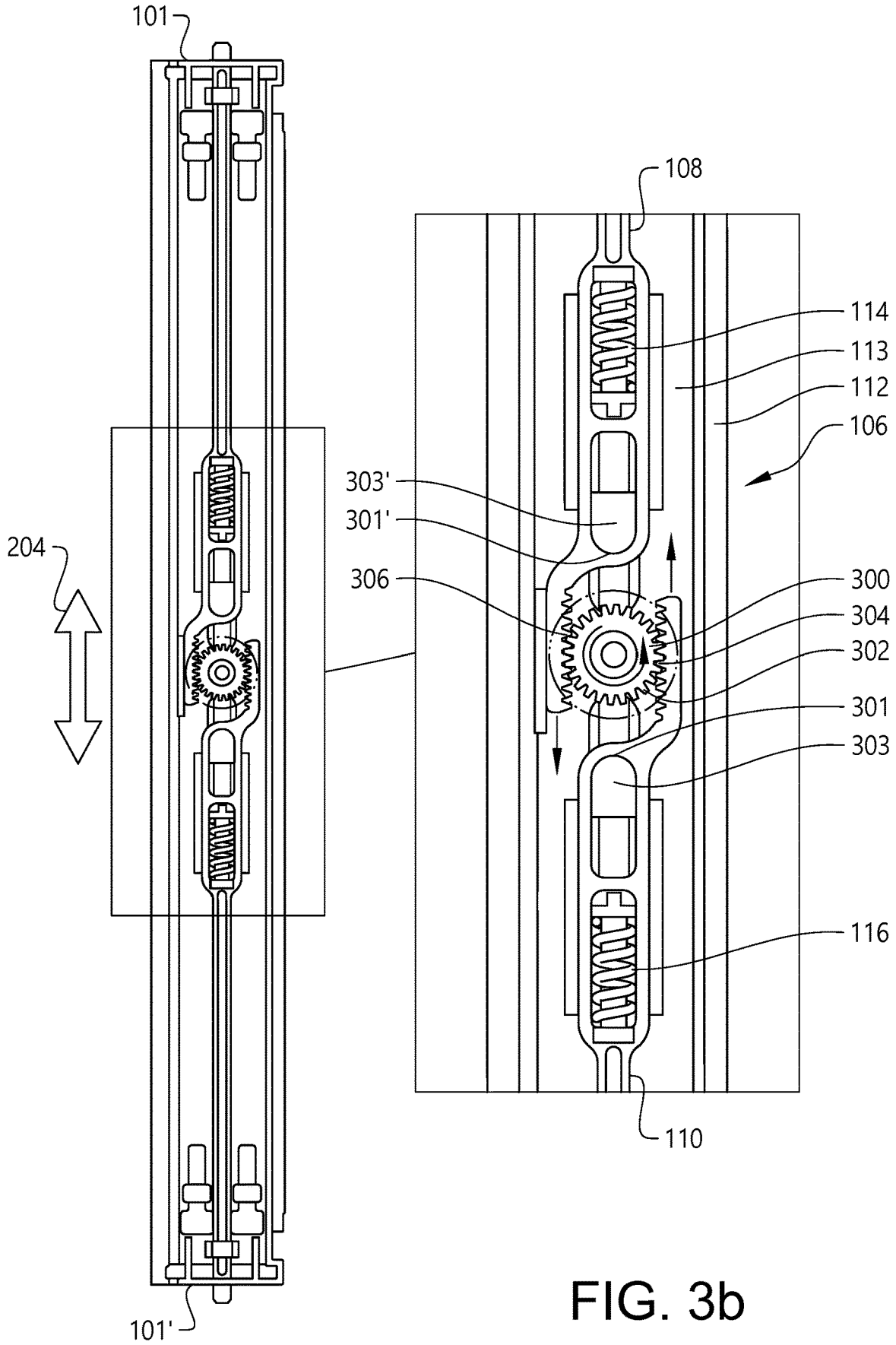

In order to describe the cover arrangement 104 in further detail, and in particular for the detailed description of the locking mechanism for connecting the cover arrangement to the storage compartment, reference is made to FIGS. 3*a*-3*b*. FIG. 3*a* illustrates the locking mechanism 106 in an exploded view while FIG. 3*b* illustrates the locking mechanism 106 in an assembled configuration. As depicted in FIGS. 3*a*-3*b*, the locking mechanism 106 comprises a first 108 and a second 110 locking pin, a locking housing 113, a first 114 and a second 116 pre-tensioned spring, a rotatable wheel 300, an actuation handle 112 and a protective cover 111.

The locking pins 108, 110 are arranged in the locking housing 113 and movable along the direction of the second geometric axis 204 between an opened and closed position. Thus, when the locking pins 108, 110 are directed outwardly and out from the upper 101 and lower 101' portions of the locking housing 113, they are arranged in the closed position, i.e. the position for connecting the cover arrangement 104 to the storage compartment 102. Moreover, the first 114 and second 116 pre-tensioned springs are connected between the locking housing 113 and the first 108 and second 110 locking pins, respectively. Hereby, the locking pins 108, 110 are arranged in a pre-tensioned configuration forcing the locking pins 108, 110 to be arranged in the closed position unless actively providing them in the opened position. The locking pins 108, 110 also comprises a respective actuation contact surface 301, 301' arranged to contact a corresponding upper 303' and lower 303 contact surface of the actuation handle 112.

Moreover, the rotatable wheel 300 is rotatably connected to the locking housing 113 and comprises gear teeth 302. The gear teeth 302 of the rotatable wheel 300 are arranged in meshed connection with gear teeth 304, 306 of the first 108 and second 110 locking pins, respectively thus forming a rack-and-pinion arrangement.

Thus, when moving the actuation handle 112 upwardly, the lower contact surface 303 of the actuation handle will contact the actuation contact surface 301 of the second locking pin and thus move the second locking pin 110 in an upward direction, i.e. towards a center of the locking housing 113. This will provide a rotational movement of the rotatable wheel 300 which will force the first locking pin 108 in a downward direction, i.e. in a direction towards the center of the locking housing 113.

The first 108 and second 110 locking pins are moved towards each other. The upper contact surface 303' of the actuation handle 112 and the actuation contact surface 301' of the first locking pin 108 will be moved away from each other. Hereby, the cover arrangement 104 is unlocked from the storage compartment 102 and the actuation handle 112 can be moved in the direction of the first geometric axis for opening the cover arrangement 104 to gain access to the storage compartment. When releasing the actuation handle 112, the pre-tensioned springs 114, 116 will force the locking pins 108, 110 towards the closed position.

The locking pins 108, 110 can also be arranged in the opened position by moving the actuation handle 112 in the downward direction. Hereby, the upper contact surface 303' of the actuation handle 112 will contact the actuation contact surface 301' of the first locking pin 108 and thus move the first locking pin 108 in the downward direction, i.e. towards a center of the locking housing 113. This will provide a rotational movement of the rotatable wheel 300 which will force the second locking pin 110 in the upward direction, i.e. towards the center of the locking housing 113. The first 108 and second 110 locking pins are moved towards each other. The lower contact surface 303 of the actuation handle 112 and the actuation contact surface 301 of the second locking pin 110 will be moved away from each other.

Figure 4A:
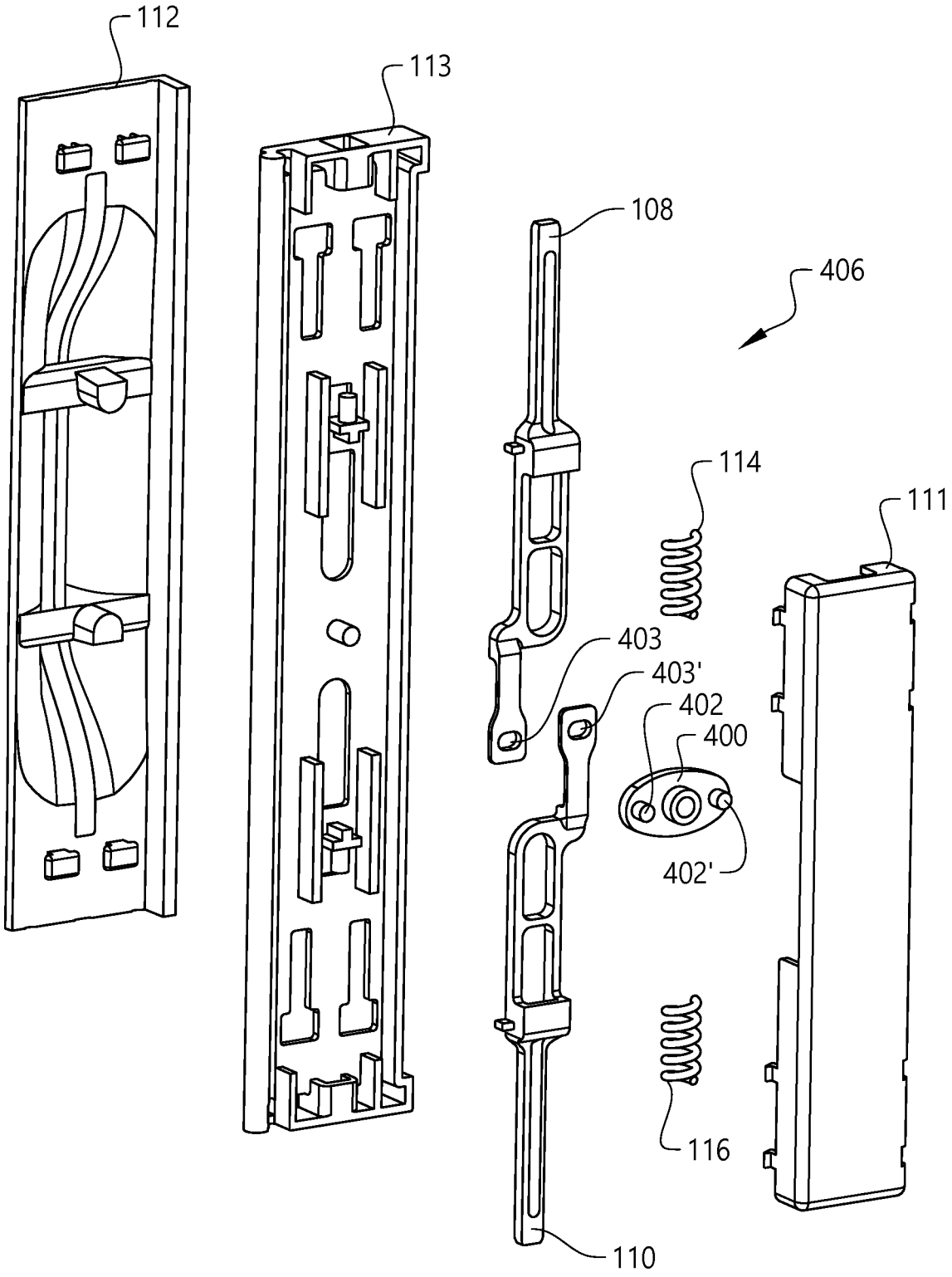
FIGS. 4*a*-4*b* illustrate another example embodiment of a locking mechanism for a cover arrangement of the vehicle storage compartment arrangement in FIG. 1.
Figure 4B:
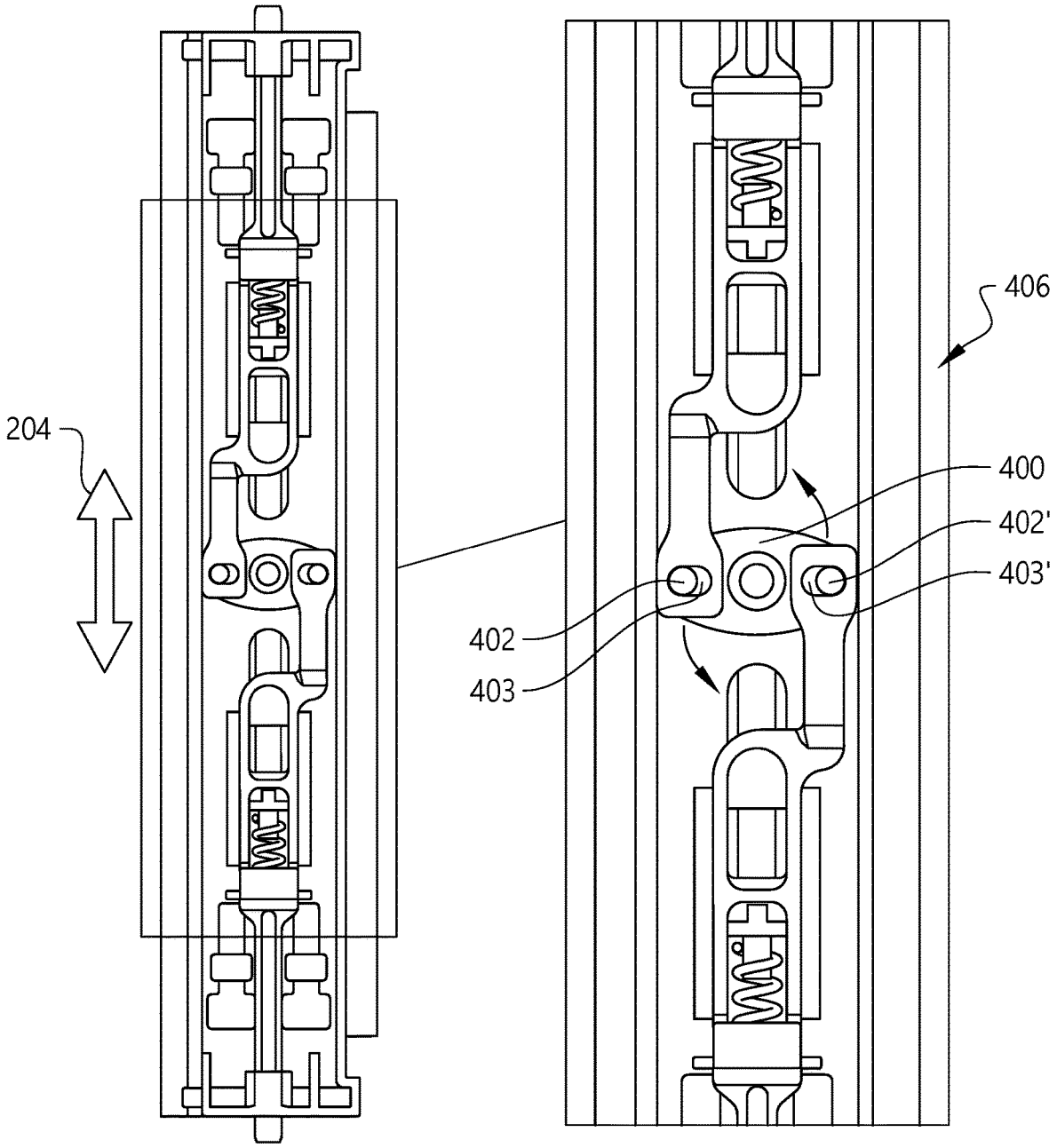

Reference is made to FIGS. 4*a*-4*b*, which illustrate another example embodiment of the locking mechanism 406. FIG. 4*a* illustrates an exploded view of the locking mechanism 406 while FIG. 4*b* illustrates the locking mechanism 406 in an assembled configuration. The main difference between the locking mechanism 106 depicted in FIGS. 3*a*-3*b* and the locking mechanism 406 depicted in FIGS. 4*a*-4*b* lies in the rotatable wheel 400 and its connection to the first 108 and second 110 locking pins. Hence, the locking mechanism 406 in the embodiment depicted in FIGS. 4*a*-4*b* also comprises a first 108 and a second 110 locking pin, a locking housing 113, a first 114 and a second 116 pre-tensioned spring, a rotatable wheel 400, an actuation handle 112 and a protective cover 111. However, the rotatable wheel in FIGS. 4*a*-4*b* is oval shaped and comprise a first 402 and a second 402' pin. Also, the locking pins 108, 110 comprise a first 403 and a second 403' opening, respectively. Hereby, the first locking pin 108 is pivotably connected to the oval shaped rotatable wheel 400 by connecting the first pin 402 of the rotatable wheel to the first opening 403 of the first locking pin 108. Similarly, the second pin 403' of the rotatable wheel 400 is connected to the second opening 403'. When one of the locking pins is moved by the actuation handle 112, the rotatable wheel 400 will rotate and force the other locking pin to be moved in the opposite direction. Hence, both locking pins 108, 110 will be moved towards the center of the locking housing 113, towards each other for unlocking the cover arrangement 104 from the storage compartment 102.

Figure 5:
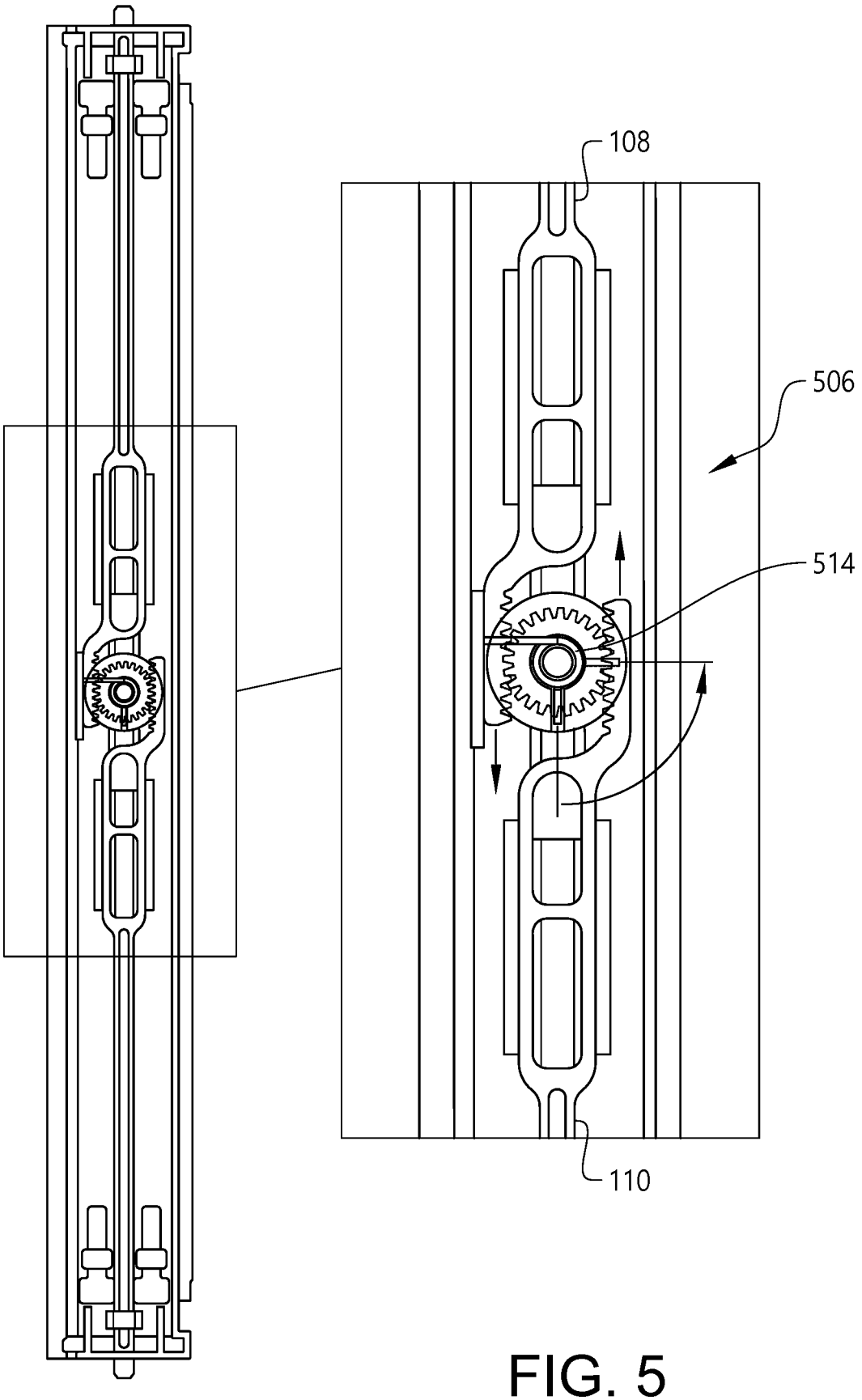
FIG. 5 illustrates yet another example embodiment of a locking mechanism for a cover arrangement of the vehicle storage compartment arrangement in FIG. 1.

Reference is now made to FIG. 5 which illustrates yet another example embodiment of the locking mechanism 506. Instead of using a pair of pre-tensioned springs as depicted in FIGS. 3*a*-4*b*, the locking mechanism 506 in FIG. 5 comprises a single pre-tensioned spring 514 arranged in the center of the rotatable wheel. The rotatable wheel in FIG. 5 comprises gear teeth and functions in a similar manner as the rotatable wheel depicted in FIGS. 3*a*-3*b*. However, the single pre-tensioned spring 514 can also be provided for the oval shaped rotatable wheel depicted in FIGS. 4*a*-4*b*. The function and purpose of the single pre-tensioned spring 514 is the same as described above for the pair of pre-tensioned springs, namely to force the first 108 and second 110 locking pins toward their closed position.

It is to be understood that the present invention is not limited to the embodiments described above and illustrated in the drawings; rather, the skilled person will recognize that many changes and modifications may be made within the scope of the appended claims.

The invention claimed is:

1. A cover arrangement for a storage compartment arranged within a vehicle, the cover arrangement being arranged to be slidably movable along a first geometric axis between an opened position and a closed position, wherein the cover arrangement comprises a locking mechanism arranged for connecting the cover arrangement to the storage compartment, the locking mechanism comprising a first and a second locking pin movable along a second geometric axis, the first and second geometric axis being substantially perpendicular to each other, wherein the first and second locking pins are arranged between a first state in which the cover arrangement is arranged to be locked to the storage compartment, and a second state in which the cover arrangement is arranged to be unlocked from the storage compartment, wherein the cover arrangement further comprises an actuation handle connected to the first and second locking pins by means of at least one pre-tensioned spring, arranged to force the first and second locking pins outwardly of the cover arrangement in a direction along the second geometric axis, wherein the first and second locking pins are arranged in the second state when the actuation handle is moved along the second geometric axis, and wherein the first and second locking pins are arranged in the second state when the actuation handle is moved in either one of a first and a second direction of the second geometric axis.

2. The cover arrangement according to claim 1, wherein the first and second locking pins are positioned on a respective side portion of the first geometric axis of the cover arrangement.

3. The cover arrangement according to claim 1, wherein the actuation handle is connected to the first locking pin by means of a first pre-tensioned spring, and to the second locking pin by means of a second pre-tensioned spring.

4. The cover arrangement according to claim 1, wherein the actuation handle is positioned in a home position when the first and second locking pins are arranged in the first state, and wherein the at least one pre-tensioned spring is arranged to re-position the actuation handle in the home position after the actuation handle is moved along the second geometric axis for arranging the first and second locking pins in the second state.

5. The cover arrangement according to claim 1, wherein the storage compartment comprises guiding rails for allowing the cover arrangement to be slidably movable along the first geometric axis, the guiding rails comprises a plurality of indentations spaced apart from each other in the direction of the first geometric axis.

6. The cover according to claim 1, wherein the cover arrangement further comprises a rotatable wheel connected to the first and second locking pins.

7. The cover arrangement according to claim 6, wherein the rotatable wheel comprises gear teeth arranged in meshed connection with gear teeth of the first and second locking pins.

8. The cover arrangement according to claim 6, wherein the rotatable wheel is an oval shaped wheel, the oval shaped wheel being pivotably connected to each of the first and second locking pins.

9. The cover arrangement according to claim 1, wherein the cover arrangement is a jalousie.

10. A vehicle comprising a vehicle compartment and a cover arrangement being arranged to be slidably movable along a first geometric axis between an opened position and a closed position, wherein the cover arrangement comprises a locking mechanism arranged for connecting the cover arrangement to a storage compartment, the locking mechanism comprising a first and a second locking pin movable along a second geometric axis, the first and second geometric axis being substantially perpendicular to each other, wherein the first and second locking pins are arranged between a first state in which the cover arrangement is arranged to be locked to the storage compartment, and a second state in which the cover arrangement is arranged to be unlocked from the storage compartment, wherein the cover arrangement further comprises an actuation handle connected to the first and second locking pins by means of at least one pre-tensioned spring, arranged to force the first and second locking pins outwardly of the cover arrangement in a direction along the second geometric axis, wherein the first and second locking pins are arranged in the second state when the actuation handle is moved along the second geometric axis, and wherein the first and second locking pins are arranged in the second state when the actuation handle is moved in either one of a first and a second direction of the second geometric axis.

11. A vehicle storage compartment arrangement comprising: a vehicle compartment and a cover arrangement being arranged to be slidably movable along a first geometric axis between an opened position and a closed position, wherein the cover arrangement comprises a locking mechanism arranged for connecting the cover arrangement to the vehicle storage compartment, the locking mechanism comprising a first and a second locking pin movable along a second geometric axis, the first and second geometric axis being substantially perpendicular to each other, wherein the first and second locking pins are arranged between a first state in which the cover arrangement is arranged to be locked to the vehicle storage compartment, and a second state in which the cover arrangement is arranged to be unlocked from the vehicle storage compartment, wherein the cover arrangement further comprises an actuation handle connected to the first and second locking pins by means of at least one pre-tensioned spring, arranged to force the first and second locking pins outwardly of the cover arrangement in a direction along the second geometric axis, wherein the first and second locking pins are arranged in the second state when the actuation handle is moved along the second geometric axis, and wherein the first and second locking pins are arranged in the second state when the actuation handle is moved in either one of a first and a second direction of the second geometric axis.

* * * * *